United States Patent [19]

Tschantré

[11] 4,100,255

[45] Jul. 11, 1978

[54] COMBUSTION OF REFUSE CONTAINING CHLORINATED HYDROCARBONS

[75] Inventor: Walter Tschantré, Zurich, Switzerland

[73] Assignee: Von Roll AG, Gerlafingen, Switzerland

[21] Appl. No.: 576,965

[22] Filed: May 12, 1975

[30] Foreign Application Priority Data

May 16, 1974 [CH] Switzerland ..... 6749/74

[51] Int. Cl.[2] ..... B01D 53/34

[52] U.S. Cl. ..... 423/210; 423/240; 423/245; 423/481; 423/488; 23/277 C; 110/342; 110/346

[58] Field of Search ..... 423/210, 245, 246, 240, 423/415, 241, 488, 481; 23/277 C; 110/8 A, 8 C, 8 R, 18 R; 261/DIG. 9

[56] References Cited

U.S. PATENT DOCUMENTS

| | | | |
|---|---|---|---|
| 983,765 | 2/1911 | Raggio | 110/18 R |
| 1,120,993 | 12/1914 | Almirall et al. | 110/23 |
| 3,268,296 | 8/1966 | Hall et al. | 423/240 X |
| 3,716,001 | 2/1973 | Potasek et al. | 110/8 C |
| 3,716,339 | 2/1973 | Shigaki et al. | 23/277 C |
| 3,780,674 | 12/1973 | Liu | 110/8 C |
| 3,858,532 | 1/1975 | Jorgensen | 110/8 C |

*Primary Examiner*—Earl C. Thomas
*Attorney, Agent, or Firm*—Flynn & Frishauf

[57] ABSTRACT

Chlorinated hydrocarbons are separated from refuse, typically municipal refuse, and combusted in a separate combustion chamber within an incinerating furnace, the special combustion chamber being separated spatially, and the material containing the chlorinated hydrocarbons being separated from refuse, so that combustion gases arising from incineration of the chlorinated hydrocarbons are kept separate from the combustion gases arising from incineration of the refuse. The chamber is of such size and shape that the chlorinated combustion gases are retained therein for a dwell time of at least one second, separate from the refuse combustion gases, to be then mixed with the cooler combustion gases resulting from incineration of the refuse, so that, upon mixture, the chlorinated hydrocarbon combustion gases will be cooled, the mixture then being purified for example by washing with water or reacting the mixture with reactants which bind hydrochloric acid and combustion compounds, the purified gases then being conducted for further disposal, for example by venting to the atmosphere.

9 Claims, 1 Drawing Figure

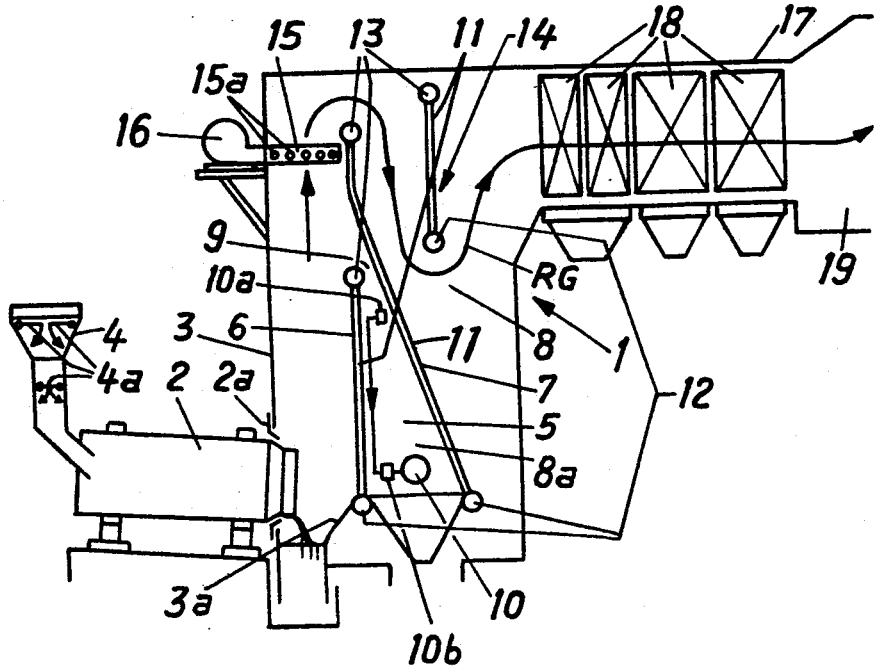
15
13
11
14
18
17
15a
16
9
10a
RG
19
4
3
6
11
8
1
4a
2
2a
7
12
5
8a
3a
10
10b

COMBUSTION OF REFUSE CONTAINING CHLORINATED HYDROCARBONS

The present invention relates to apparatus and method for simultaneous combustion of refuse, typically municipal refuse and substances containing chlorinated hydrocarbons in a common incinerating furnace.

It has previously been proposed to incinerate refuse, particularly municipal refuse which contains among others materials which contain chlorinated hydrocarbons by incinerating the entire refuse in a common incinerating furnace. Optimum temperature of operation of an incinerator for incineration of refuse, such as the typical municipal refuse picked up by municipalities, sanitation departments, and the like, requires a furnace temperature of about 900° C. Incineration of chlorinated hydrocarbons in such furnaces is uncontrolled. The incineration temperature is a more or less effective compromise between the optimum incineration of chlorinated hydrocarbons and the remainder of the refuse. The optimum furnace temperature for incineration of chlorinated hydrocarbons is about 1200° C; if an incineration furnace would be operated at such temperature, fly ash would melt or slag, or cake.

It is an object of the present invention to provide a method and an incineration furnace which can effectively incinerate chlorinated hydrocarbons as well as municipal refuse of the ordinary kind.

SUBJECT MATTER OF THE PRESENT INVENTION

Briefly, chlorinated hydrocarbons are separated from refuse. They are introduced into a separate incineration space or combustion chamber within the incinerating furnace; separated spatially as well as materially (that is, the material containing chlorinated hydrocarbons is separated from the remainder of the material) and the chlorinated hydrocarbon articles are incinerated in this separate furnace space or cell. The gases arising upon incineration of the chlorinated hydrocarbon articles are retained with a dwell time of at least one second separate from the gases derived from incineration of the refuse, for example by being retained while flowing in the chamber. They are, thereafter, conducted into the main gas stream derived from incineration of the refuse, to be cooled thereby; the mixture of gases is then purified, for example by washing with water, or by dry purification by means of reagents reacting with hydrochloric acid, to be then disposed of, for example by conducting into the free atmosphere.

In accordance with a feature of the invention, the furnace or incinerator has a separate combustion cell located within the main incineration furnace area, the separate combustion cell being charged with articles containing chlorinated hydrocarbons, and being at least approximately gas-tight with respect to the combustion area of the remainder of the furnace.

The invention will be described by way of example with reference to the accompanying drawing, wherein the single FIGURE illustrates, in highly schematic form, a longitudinal cross section through an incinerator furnace, in which the method of the invention can be carried out.

The incinerator, generally designated by 1, has a combustion drum 2 for refuse and a subsequently arranged combustion or incinerating chamber 3. Refuse, which may include articles made of hydrocarbon compounds, such as plastic of various kinds, is introduced to the rotating drum 2 by means of a fill hopper 4. Fill hopper 4 has flaps 4a. The drum 2 is provided with a seal *2a* at its exit opening, that is, where it fits into the main combustion chamber 3, so that a certain vacuum can form within the incinerator 1, and stray air is prevented from entering.

A separate combustion cell 5 for chlorinated hydrocarbons is located within the incineration or furnace chamber of the combustion chamber 3. Cell 5 has a front wall 6 and a back wall 7. These walls may be tubular, with or without embossing, the walls being fitted to the sidewalls 8 of the furnace. The sidewalls 8a of the cell 5 are formed by respective zones or regions of the sidewalls 8 of the furnace itself. Incineration of articles within the cell 5 is thus carried out separately from any processes within the remainder of chamber 3. Combustion or incinerating gases resulting from incineration of chlorinated hydrocarbon articles within cell 5 are, therefore, also separated from the gases resulting from incineration of the remainder of the refuse and which occur within the remainder of the chamber 3. The two walls 6, 7 of the cell 5 are not heat-insulated; they are, however, practically gas-tight with respect to the remainder of the interior of the furnace chamber 3, communicating with the furnace chamber 3 only by an opening 9 in the upper zone of the cell 5. A burner 10 is located at the lower portion of the cell 5, for example secured to the sidewall *8a*. The burner 10 is capable of handling two types of supply. The burner 10 serves as a supply, also, for chlorinated hydrocarbons which are introduced thereby into the cell 5; additionally, a combustion-supporting fuel is supplied, for example used oil, drained crank case oil, excess or unused heating gas, or other combustion-sustaining fuel, together with the necessary combustion air. The carrier fuel is used to start combustion within cell 5, and then is added if and as needed, during operation, as a combustion-supporting substance for the chlorinated hydrocarbons within cell 5. Control of the substances introduced into the two-component burner 10 is automatic, by sensing the temperature within the cell 5. A temperature sensor, schematically indicated at *10a*, and a controller, schematically indicated by *10b*, are used to control operation of the burner 10. Such sensors and controllers are known as such.

The walls 6, 7 are made of embossed or non-embossed tubes 11, connected to manifolds or distribution tubes 12, and to a collecting manifold 13, and forming part of a steam, or hot-water boiler which, in turn, forms part of the incinerating furnace. The rear wall 7 of the cell 5 extends above the front wall 6 of the cell and, in combination with a further tubular wall 14 forming a flue baffle, causes the gas stream to carry out a zig-zag, undulating tortuous gas path, as schematically illustrated in the Figure by the arrow RG. The further tubular wall 14 has a distribution manifold 12 and a collecting manifold 13, which manifolds are likewise connected to the steam, or hot-water system of the furnace.

A secondary air gate 15 is located in the upper region of the rear wall 7 of the cell 5. The gate 15 has air nozzles 15a through which air can be supplied by means of a secondary air blower 16. Auxiliary, or secondary, or pre-heater surfaces 18 are located in a horizontal flue path 17. The preheaters 18 may be used to pre-heat air, or water. A gas purifier 19 is located downstream from the pre-heater surfaces 18, joining the horizontal flue portion 17. The gas purifier 19 may be water-operated gas-washing device which removes dust and solid particles from the smoke and gases, and further washes off the poisonous hydrochloric acid from the smoke gases. Precipitators and solid reactants to bind hydrochloric acid may also be used.

The height and cross section of the incinerating cell 5 for chlorinated hydrocarbons is so dimensioned that the dwell time of the resulting combustion or incinerating gases flowing through the cell is at least one second, while considering the pressure introduced by the combustion pressure due to the twocomponent burner 10, and air introduced thereby.

Operation: Combustion of ordinary (nonchlorinated hydrocarbon-containing) refuse in drum 2 results in gases which enter the post-combustion chamber 3. The solid residue falls from drum 2 into the slag hopper 3a. The volatile, still combustible components in the smoke and gases derived from drum 2 are burned in the chamber 3. An igniter, associated with burner 10 (not shown) ignites the chlorinated hydrocarbons introduced into the burner 10, for example by being blown thereinto. To start ignition — and, if necessary also during combustion — additional combustible substance is introduced, for example by means of an atomizing nozzle; residual oils, used crank case oils, or other combustionsupporting substances are introduced in such quantity that a temperature of at least about 1200° C will result within cell 5, and the resulting gases will have a dwell time within the cell 5 of at least one second. After this dwell time, the gases derived from combustion of the chlorinated hydrocarbons are introduced through opening 9 into the interior of the remainder of the chamber 3. The postcombustion chamber 3 has entirely different conditions prevailing therein, primarily a temperature which is substantially below the 1200° C of the incinerating temperature within chamber 5 for example in the order of about 900° C. Additionally, the gas flow speeds are different. The cooler smoke and combustion gases from incineration of the refuse are mixed with the hot gases derived from combustion of the chlorinated hydrocarbons, thus cooling the chlorinated hydrocarbon combustion gases. The secondary air gate 15 ensures that any still present combustible components are burned. The two cell walls 6, 7 are cooled by passing water through their tubes 11, which water is heated thereby.

The mixture formed of refuse combustion gases and chlorinated hydrocarbon combustion gases then passes over the pre-heater surfaces 18, where the gas mixture is further cooled. It is thereafter purified and detoxified in the purification apparatus 19, which permits efficient and reliable, simple and relatively inexpensive detoxification and purification. The gases may, after purification, be vented to the atmosphere or otherwise disposed of.

Various changes and modifications are possible in the method, as well as in the structure of the furnace. Thus, rather than using a rotary combustion drum 2 for refuse, combustion can be carried out on a combustion grate having one or more grate units. A single two- component burner for chlorinated hydrocarbons and carrier or incineration-supporting fuel can be located on one sidewall of the cell or one or more such burners may be secured to both sidewalls of the cell 5. The burners 10 within cell 5, as shown, are arranged at the bottom thereof so that the gas is emitted at the top; the arrangement can be reversed, however. The mixture of chlorinated hydrocarbon combustion gases and refuse combustion gases may be washed with water, but dry HCl removing reagents may be used instead, combined, if necessary, with precipitators and/or other apparatus removing dust and solid particles before conducting the gases to atmosphere. The walls 6, 7 need not be tubular, watercontaining cooled boiler tubes, but may also be fixed masonry walls made of fire brick and forming part of the masonry construction of the furnace. Various other changes and modifications may be made within the scope of the inventive concept, the drawing being generally illustrative and schematic to illustrate this inventive concept.

Separating combustion of refuse and chlorinated hydrocarbons in a separate combustion furnace is generally inefficient since any furnace has substantial radiation and convection heat losses; this is not the case in the furnace in accordance with the present invention in which useful heat output is available from combustion of both the chlorinated hydrocarbons as well as of other refuse. Suitable materials to neutralize H Cl include quicklime, slaked lime, Mytrid (= burnt magnesite)

I claim:

1. Method for simultaneous combustion of refuse and chlorinated hydrocarbons in a single furnace having
   - a refuse combustion chamber (3) and a separate incineration cell (5) located within at least a portion of the chamber (3) comprising the steps of
   - introducing the chlorinated hydrocarbons into the cell (5) separately and apart from refuse; introducing refuse into the chamber (3);
   - incinerating said separate chlorinated hydrocarbons in said incineration cell (5) and whereby chlorinated hydrocarbon combustion gases will be generated;
   - combusting the refuse in the chamber (3) at a combustion temperature below that of the chlorinated hydrocarbon incinerating temperature and generating refuse combustion gases at a temperature below that of the chlorinated hydrocarbon combustion gases;
   - retaining the chlorinated hydrocarbon combustion gases while flowing in said cell (5) for a dwell time period of at least one second, separate from the refuse combustion gases;
   - then mixing the chlorinated hydrocarbon combustion gases and the cooler refuse combustion gases to cool the chlorinated hydrocarbon combustion gases in the mixture;
   - and then purifying the cooled mixture of refuse combustion gases and chlorinated hydrocarbon combustion gases.

2. Method according to claim 1, wherein the purifying step comprises washing with water.

3. Method according to claim 1, wherein the purifying step comprises reacting the mixture with reactants which bind hydrochloric acid.

4. Method according to claim 1, further comprising the step of conducting the purified gases to free atmosphere.

5. Method according to claim 1, further comprising the step of introducing a combustion-supporting fuel into said separate, incineration cell (5) at least upon initiation of burning said separated chlorinated hydrocarbons in said cell.

6. Method according to claim 5, further comprising the step of controlling the introduction of additional fuel in dependence on sensed temperature within said separate incineration cell (5).

7. Method according to claim 1, further comprising the step of cooling the mixture of chlorinated hydrocarbon combustion gases and refuse combustion gases obtained by said mixing step before carrying out said purifying step.

8. Method according to claim 1, further comprising the step of introducing secondary air into the furnace in a region where the chlorinated hydrocarbon combustion gases and the refuse combustion gases are being mixed.

9. Method according to claim 1, wherein the temperature of combustion of the refuse in the chamber (2, 3) is in the order of about 900° C; and the temperature of incineration of said chlorinated hydrocarbons is in the order of at least about 1200° C.

* * * * *